US007861391B2

(12) United States Patent
Giesler et al.

(10) Patent No.: US 7,861,391 B2
(45) Date of Patent: Jan. 4, 2011

(54) METHOD OF AND DEVICE FOR MOUNTING AND FUNCTIONAL VERIFICATION OF ROLL FITTINGS

(75) Inventors: Otmar Giesler, Kreuzthal (DE); Edgar Filk, Netphen (DE); Michael L. VanBibber, McDonald, PA (US); David A. Nold, Cranberry Township, PA (US)

(73) Assignee: SMS Siemag Aktiengesellschaft, Duesseldorf (DE)

( * ) Notice: Subject to any disclaimer, the term of this patent is extended or adjusted under 35 U.S.C. 154(b) by 1121 days.

(21) Appl. No.: 11/578,282

(22) PCT Filed: May 13, 2005

(86) PCT No.: PCT/EP2005/005247

§ 371 (c)(1),
(2), (4) Date: Oct. 10, 2006

(87) PCT Pub. No.: WO2005/118172

PCT Pub. Date: Dec. 15, 2005

(65) Prior Publication Data

US 2008/0028599 A1 Feb. 7, 2008

(30) Foreign Application Priority Data

May 26, 2004 (DE) ..... 10 2004 025 984

(51) Int. Cl.
*G01M 19/00* (2006.01)

(52) U.S. Cl. ..... 29/407.01; 29/428; 72/238

(58) Field of Classification Search ..... 29/407.1, 29/428; 72/238
See application file for complete search history.

(56) References Cited

U.S. PATENT DOCUMENTS

| | | | | |
|---|---|---|---|---|
| 4,471,642 | A * | 9/1984 | Wilson | 72/238 |
| 4,974,437 | A | 12/1990 | Schiller | |
| 5,038,594 | A | 8/1991 | Svagr | |
| 7,784,316 | B2 * | 8/2010 | Witschas | 72/7.1 |

FOREIGN PATENT DOCUMENTS

| | | |
|---|---|---|
| DE | 2129337 | 3/1973 |
| DE | 2356785 | 5/1975 |

OTHER PUBLICATIONS

Successful modernisation of Outokumpu's No. 1 Sendzimir mill Roggo, B; Thurotte, D C D.M.S. Metallurgical Plant and Technology International (Germany), v 22, n 3, p. 122-124, Jun. 1999, Publication Date: 1999.*

* cited by examiner

*Primary Examiner*—Derris H Banks
*Assistant Examiner*—Azm Parvez
(74) *Attorney, Agent, or Firm*—Abelman, Frayne & Schwab

(57) ABSTRACT

A method of and a device for mounting and functional verification of roll fittings (4) in rolling mill stands (1), wherein at least a partial number of the roll fittings (4) forms a respective module (5), with savings of mounting and verification time, and wherein the modules (5) are arranged, for pre-assembly with functional verification, on a mounting plate outside of the roll stand (1), is adjusted and/or verified, and at least one adjusted and/or verified module (5) is operatively arranged between two rolling mill stands (1), primarily, in the stand gap (9) and is arranged on a base frame (8) at constructively fixable support points (10).

1 Claim, 3 Drawing Sheets

METHOD OF AND DEVICE FOR MOUNTING AND FUNCTIONAL VERIFICATION OF ROLL FITTINGS

Figure 1:
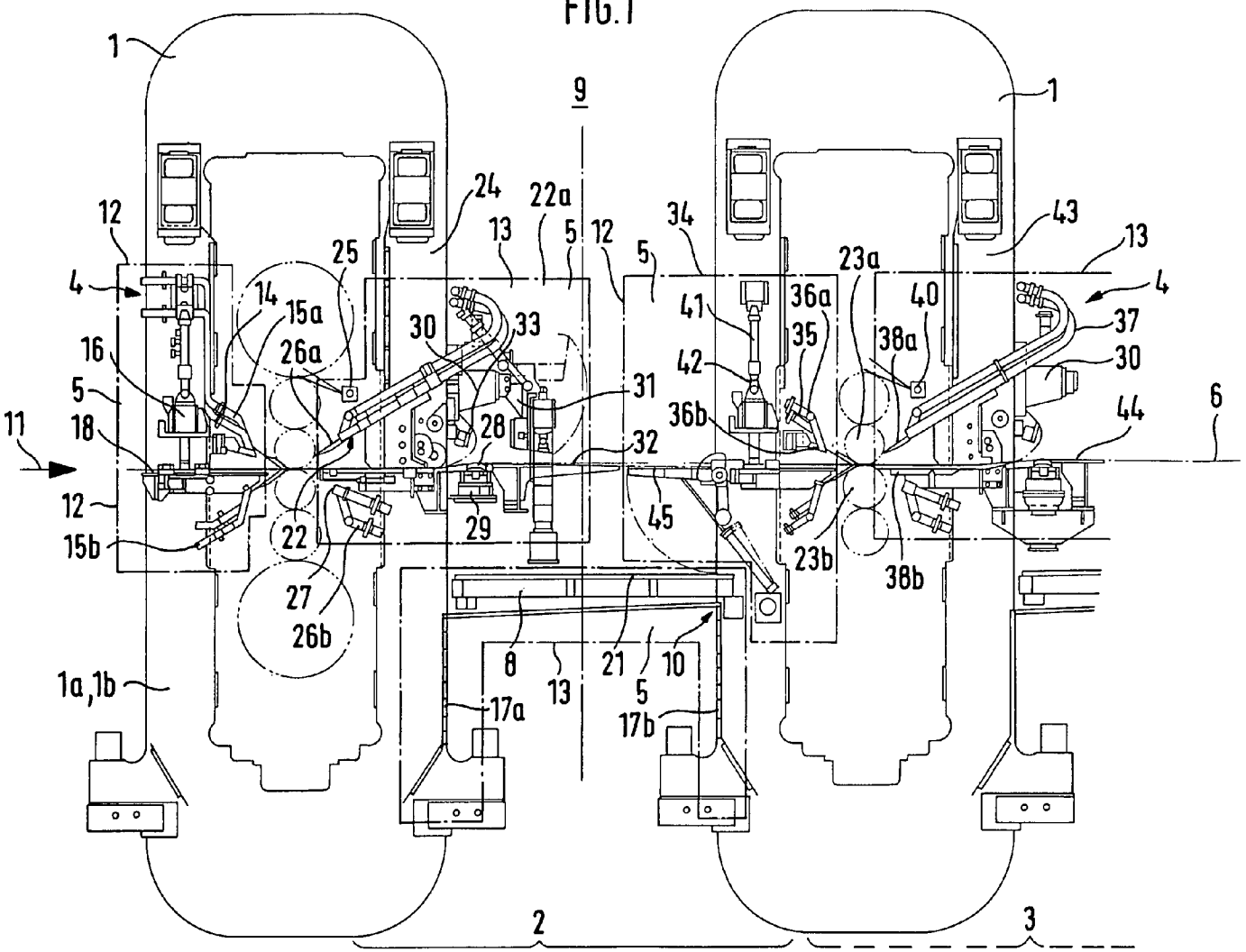

The invention relates to a method of and a device for mounting and function verification of roll fittings in rolling mill stands or rolling mill trains such as, e.g., tandem rolling mill trains, wherein at least a partial number of roll fittings forms a respective module that is operatively secured on a respective roll housing.

Such a module is disclosed in EP 0 349 840 A2. There, separated from each other, modules are mounted essentially outwardly on a rolling mill stand of a rolling mill, which not only requires additional and relatively large space but also are accessible with much difficulty and are correspondingly more difficult to maintain and serve. There, is described, as known, a module with arranged, at the rolling mill entry and exit sides strip deflector arms, spray devices, strip lifting devices, delivery rails, and strip guide tables, wherein the strip lifting devices with the strip deflector arms, spray device, delivery rails, and strip guide tables are combined in a module and are arranged within the rolling mill stand in an immediate vicinity of the roll gap of the working rolls. Separate devices can also be integrated in a working roll bending block. Though such construction proved itself, nevertheless, some issues, which have to be improved or were not considered up to now, remain.

The object of the invention is to simplify handling of a module during mounting and functional verification, and to carry out the work more rapidly and in time-saving manner.

The object of the invention is achieved according to the invention, in that the modules are arranged, for pre-assembly with functional verification, on a mounting plate outside of the rolling mill stand, adjusted and/or verified, and that at least one adjusted and/or verified module is operatively arranged between two rolling mill stands, primarily in a stand gap, and is secured at constructively fixable support points of roll housings.

The main advantage consists in a possible pre-verification of all of the elements outside of the rolling mill stand, e.g., in a workshop, in a time-saving pre-wiring of sensors and piping of medium consumers. Thereby, the final assembly in the rolling mill stand is significantly simplified, e.g., reduced in time, as separate units need not be any more mounted and verified, rather a compact module is. Therefore, assembly time on a constructional site is reduced, the starting time is also shortened and, besides, the attachment points on the rolling mill stand can be selected and fixed already during the design stage, and wherein these constructive advantages are independent of the to-be-used components. All in all, significant amount of time and expenses are saved.

According to further features, it is proposed that an entry side module is arranged in a rolling direction in the first rolling mill stand of a rolling mill train between associated with each other, roll housings of the first rolling mill stand. The related module can also be used on a separate rolling mill stand. With this, the pre-assembly with the functional verification is likewise carried out outside of the pitch line, preferably in a workshop.

It is further proposed that an exit side module and an entry side module are arranged in a rolling direction between a first rolling mill stand and a second rolling mill stand.

A device for mounting, and functional verification of roll fittings in rolling mill stand or rolling mill trains such as, e.g., tandem rolling mill trains, wherein at least a partial number of the roll fittings forms a respective module which is operatively secured on respective roll housings, is so formed according to the invention that according to further features, an entry side module includes at least:

an entry side spray bar for emulsions,
an upper spray bar for roll gap lubrication,
a lower spray bar for roll gap lubrication,
a strip clamping device,
spray protection walls, and
strip guide table, and outside of the rolling mill stand is verified and/or adjusted on a mounting plate, and inside of the rolling mill stand, is arranged on a base frame.

The foregoing elements form a module.

In addition, if desired, the base frame can be used as the mounting plate.

According to one of the embodiments, a module is arranged between two rolling mill stands of a rolling mill train which follow each other in the rolling direction, and is formed of at least one exit side module and one entry side module. Here, the two module can form a common module in case such embodiment is advantageous.

According to a further development of the present invention, the entry side and exit side modules are mounted on a base frame within a common module between the following each other in the rolling direction, rolling mill stands.

It is further provided that the exit side module and the entry side module, in a mounted condition, are arranged on a base frame of side protection walls and two cross-beams, and a service bar grate is provided.

According to other features, it is contemplated that the exit side module includes at least the following objects:

a strip deflection arm for upper and lower working rolls,
a stand gap purification bar,
an upper purification and cooling bar,
a lower purification and cooling bar,
a strip data measuring device,
a strip tension measuring roller,
a support with a protection device for strip speed measuring device,
a protection device for a strip thickness measuring device,
a stationary strip guide table, and
a strip hold-down roller with an integrated strip cooling device.

The foregoing objects form at least one of the modules within the stand gap.

A base frame which is formed of two cross-beams and side protection walls in a pitch line in the rolling mill train and within a rolling mill stand for receiving identical, similar, or different modules for final assembly and the ready-for-operation condition, can serve as a base for the working device and method.

The drawings show embodiments of the invention which would be discussed in detail below.

Figure 2:
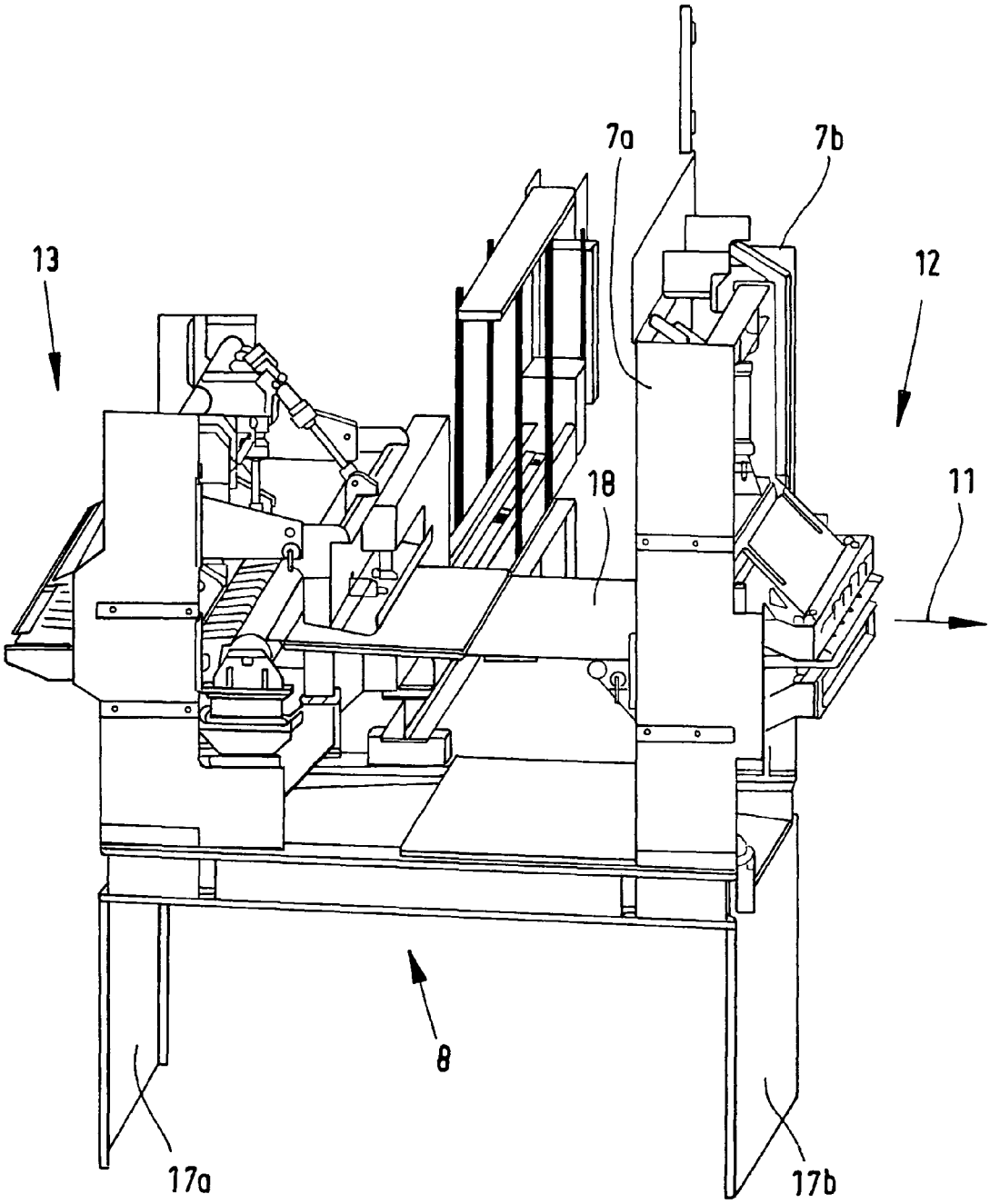
Figure 3:
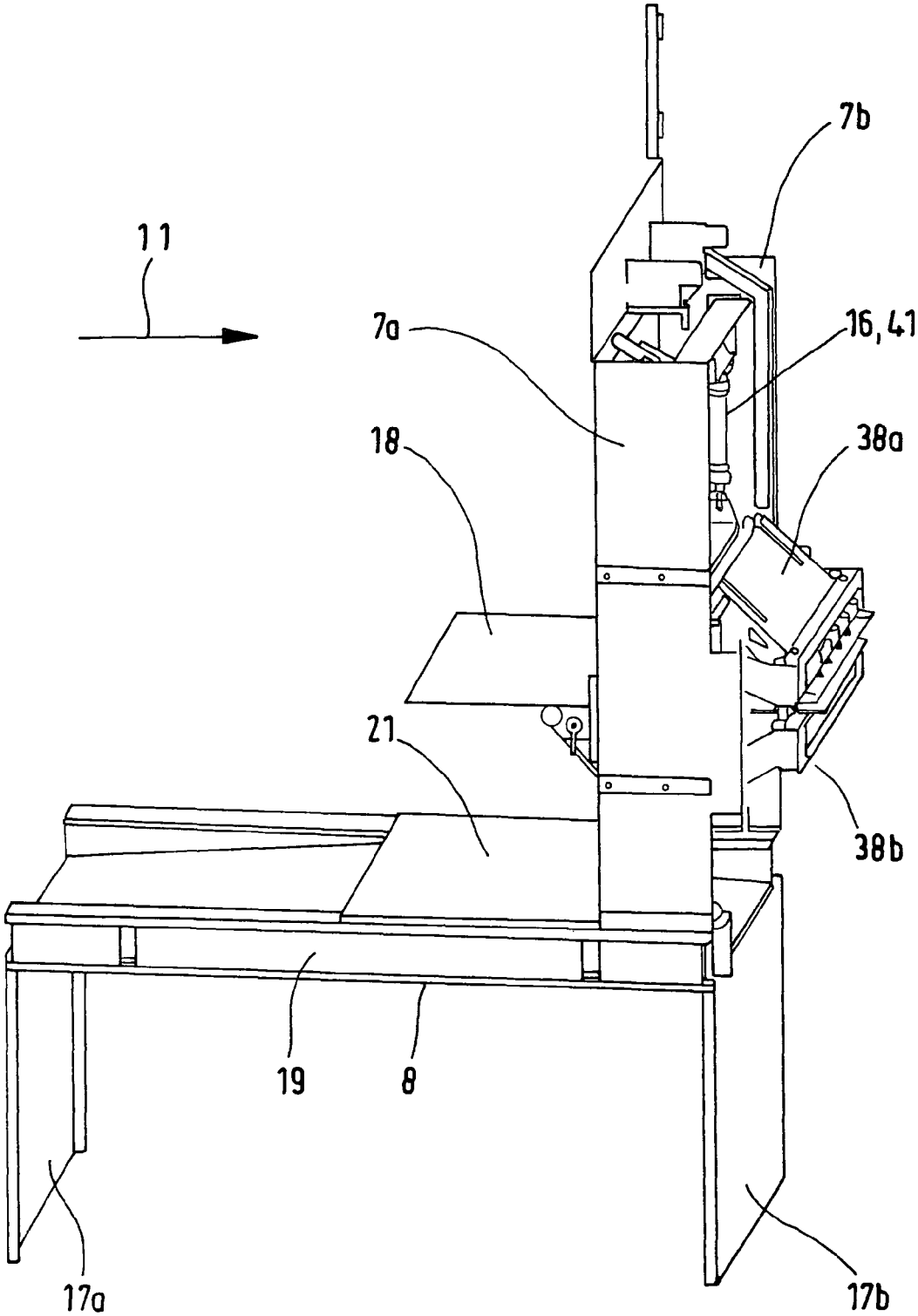

The drawings show:

FIG. 1 a side view of a portion of a rolling mill train, e.g., of a tandem rolling mill, FIG. 2 a perspective view of a base frame for receiving separate subassemblies of one or several modular units in a space between rolling mill stands outside of a pitch line, i.e., for pre-assembly with functional verification in a workshop with respective entry side module and exit side module; and FIG. 3 the same base frame with only one module.

FIG. 1 shows two separate rolling mill stands 1 arranged along a pitch line 6. Each rolling mill stand 1 consists (transverse to the rolling direction 11) of arranged one after another roll housings 1*a* and 1*b*. Several of such rolling mill stands 1 form a rolling mill train 2, e.g., a row of five rolling mill stands 1 can represent a tandem rolling mill train 3. Each of the rolling mill stands 1 is equipped with roll fittings 4. The roll fittings 4 form identical and/or similar and/or different modular units 5. Those modular units 5 further will be referred to as "modules".

The modules 5 are secured on a base frame 8 (see FIGS. 2 and 3) in each rolling mill stand 1 and in a stand gap 9 between the rolling mill stands as entry side module 12 and exit side module 13. The base frame 8 forms a special independent module 8 in the stand gap 9. The base frame 8 consists of two cross-bars 19, side protection walls 17*a*, 17*b*, and a bar grate 21.

In the stand gap 9, there are arranged, on the base frame 8, on the left, the exit side module 13 and on the right, the entry side module 12. In the stand gap 9, constructively, support points 10 is associated with these modules 5 and is secured there. The support points 10 can already be secured during a design stage, independent from to-be-installed modules 5.

The advantages of the invention are achieved in that the modules are mounted, for pre-assembly with function verification, on a mounting plate (not shown) outside of the rolling mill stand 1, e.g., in a workshop, are adjusted outside of the rolling mill stand 1 and/or tested, and in that at least one adjusted and/or tested module is arranged between the rolling mill stands, primarily, in the stand gap 9 and is secured on constructively fixable support points 10 of the roll housing 1*a*, 1*b*.

Below, examples for a module 5 as the entry side module 12 will be described: the roll fittings 4 have entry side spray-bar for emulsion. Also are provided an upper spray bar 15*a* for lubrication of the roll gap and a lower spray-bar 15*b* for lubrication of the roll gap. In front of them, a strip clamping device 16 is arranged. The rolled strip is guided by a strip guide table 18. In the rolling direction 11, such a module 5 can be arranged in the first rolling mill stand 1 of the rolling mill train 2 as the entry side module 12 between the associated with each other, roll housings 1*a*, 1*b*.

The module 5 is mounted in the stand gap 9 on the base frame 8 of two cross-beams 19 with opposite side protection 17*a*, 17*b*, with a bar grate 21 being used for operations of the service personnel. The base frame 8 is held at the support points 10.

Now, below, an embodiment of another module 5 will be described as an exit side module 13: here, the exit side module 13 is designated as a gap exit side module 22*a* and is provided with a strip deflector arm 22. A lower working roll 23*b* is associated with the strip deflector arm 22. The roll fittings 4 are secured on roll housing walls 24. An intermediate purifying bar 25 and upper purifying and cooling bar 26 and lower purifying and cooling bar 26*b* are associated with the roll set of working and support rolls. Between the components, a strip data measuring device 27 is located. In front of entrance of the right rolling mill stand 1, a strip tension-measuring roller 28 is located. A support and a protection device 29 for strip speed measuring means surrounds it. In addition, a support 30 for the strip speed measuring device is secured on the base frame 8. There is also provided a protection device 31 for a strip thickness measuring device. Also is shown a stationary strip guide table 32 with a strip hold-down roller 33 with an integrated strip cooling device. The module 5, i.e., the entry side module 12 forms here an stand gap entry module 34. Correspondingly (analogous to the entry side spray bar 14), an entry side emulsion spray bar 35 is formed. This one consists (analogous to 15*a*, 15*b*) of an upper spray bar 36*a* for roll gap lubrication and a lower spray bar 36*b* for roll gap lubrication. In addition, here, the exit-side module 13 has an emulsion spray system 37 with a multi-zone cooling lubricant. Analogous to spray bars 15*a*, 15*b*, there are provided upper spray bar 38*a* for roll gap lubrication and multi-zone cooling and lower spray bar 38*b* for roll gap lubrication and multi-zone cooling. A stand gap purification bar 40 corresponds to the stand gap purification bar 25. A strip clamping device 41 with accessories corresponds to the strip clamping device 16, wherein the drive region of the strip clamping device 41 is designated with 42. These elements are secured on a roll housing wall 43. Likewise, a guide table 44 and an oscillating strip guide table 45 are provided.

FIG. 2 shows a construction for a pre-assembly with functional verification outside the pitch line 6, e.g., in a workshop. The entry-side module 12 and the exit-side module 13 are provided with accompanying spray protection walls 7*a* and 7*b*. The base frame 8 is provided with side protection walls 17*a*, 17*b* for a later mounting on the roll housing walls 1*a*, 1*b*.

According to FIG. 3, the base frame 8 is shown with the two cross-beam 19 and side protection walls 17*a*, 17*b*. In the rolling direction 11, there are arranged the strip guide table 18, the side protection walls 17*a*, 17*b*, the strip clamping device 16, 41, and upper and lower spray bars 38*a* and 38*b*.

LIST OF REFERENCE NUMERALS

1. Rolling mill stand
1*a*. Roll housing
1*b*. Roll housing
2. Rolling mill train
3. Tandem rolling mill train
4. Roll fittings
5. Module
6. Pitch line
7*a*. Spray protection wall
7*b*. Spray protection wall
8. Base fame
9. Stand gap
10. Support point
11. Rolling direction
12. Entry-side module
13. Exit-side module
14. Entry-side spray bar for emulsion
15*a*. Upper spray bar for roll gap lubrication
15*b*. Lower spray bar for roll gap lubrication
16. Strip clamping device
17*a*. Side protection wall
17*b*. Side protection wall
18. Strip guide table
19. Two cross-beams.
20.
21. Bar grate
22. Strip deflection arm for working rolls
22*a*. Stand gap exit-side module
23*a*. Upper working roll with a strip deflection arm
23*b*. Lower working roll with a strip deflection arm
24. Roll housing wall
25. Stand gap purification bar
26*a*. Upper purification and cooling bar
26*b*. Lower purification and cooling bar
27. Measuring device for strip data
28. Strip tension measuring roller
29. Support and protection device for strip speed measuring
30. Support for strip speed measuring device
31. Protection device for strip thickness measuring device
32. Stationary guide table
33. Strip hold-down roller with an integrated strip cooling device
34. Stand gap entry module

35. Entry-side emulsion spray bar
36*a*. Upper spray bar for roll gap lubrication
36*b*. Lower spray bar for roll gap lubrication
37. Emulsion spray system for a multi-zone cooling and lubrication
38*a*. Upper spray bar for roll gap lubrication and a multi-zone cooling
38*b*. Lower spray bar for roll gap lubrication and a multi-zone cooling
39.
40. Stand gap purification bar
41. Strip clamping device with accessories
42. Drive zone of the strip clamping device
43. Roll housing wall
44. Guide table
45. Oscillating strip guide table.

The invention claimed is:

1. A method of mounting and functional verification of roll fittings (4) in rolling mill stands (1) or rolling mill trains (2), wherein at least a partial number of the roll fittings (4) forms a respective module (5) which is operatively secured on respective roll housings (1*a*; 1*b*), wherein the modules (5) are arranged, for pre-assembly with functional verification, on a mounting plate outside of the rolling mill stand (1), adjusted and/or verified, and at least one adjusted and/or verified module (5) is operatively secured at constructively fixable support points (10) of the roll housings (1*a*; 1*b*), characterized in that an entry side module (12), which is adjusted and/or verified on a mounting plate outside of the rolling mill stand, is arranged in a rolling direction (11) in the first rolling mill stand (1) of a rolling mill train (2) between the roll housings (1*a*; 1*b*) of the related rolling mill stand (1), and in that in the rolling direction (11), between a first rolling mill stand (1) and a second rolling mill stand (1), an exit side module (13), which is likewise adjusted and/or verified on the mounting plate outside of the rolling mill stand (1), and an entry side module (12) are arranged on a base plate (8), being supported thereon.

* * * * *